US009227206B2

(12) United States Patent
Yu

(10) Patent No.: US 9,227,206 B2
(45) Date of Patent: Jan. 5, 2016

(54) SPRINKLER STRUCTURE

(71) Applicant: ZHONGSHAN QING YI METAL PRODUCTS ENTERPRISE CO., LTD., Guangdong Province (CN)

(72) Inventor: Tang-Chieh Yu, Taichung (TW)

(73) Assignee: Zhongshan Qingyi Metal Products Enterprise Co., Ltd., Guangdong Province (CN)

( * ) Notice: Subject to any disclaimer, the term of this patent is extended or adjusted under 35 U.S.C. 154(b) by 0 days.

(21) Appl. No.: 14/301,432

(22) Filed: Jun. 11, 2014

(65) Prior Publication Data

US 2015/0196929 A1 Jul. 16, 2015

(30) Foreign Application Priority Data

Jan. 13, 2014 (CN) ..... 2014 1 0015109

(51) Int. Cl.
*B05B 3/04* (2006.01)
*B05B 1/20* (2006.01)

(52) U.S. Cl.
CPC ..... *B05B 3/0409* (2013.01); *B05B 1/20* (2013.01)

(58) Field of Classification Search
CPC ..... B05B 3/02; B05B 3/0422; B05B 3/044; F02M 61/166
USPC ..... 239/225.1, 263, 237, 239, 242, 246, 239/251, 255, 256, 263.3, 397.5, 200, 210
See application file for complete search history.

(56) References Cited

U.S. PATENT DOCUMENTS

| | | | | |
|---|---|---|---|---|
| 7,226,000 | B2 * | 6/2007 | Huang | B05B 3/044 239/237 |
| 7,988,067 | B2 * | 8/2011 | Miller | B05B 3/0436 239/237 |
| 8,998,108 | B2 * | 4/2015 | Hsieh | 239/242 |
| 2011/0226867 | A1 * | 9/2011 | Mayher | B05B 3/044 239/70 |

* cited by examiner

*Primary Examiner* — Arthur O Hall
*Assistant Examiner* — Christopher R Dandridge
(74) *Attorney, Agent, or Firm* — Rosenberg, Klein & Lee

(57) ABSTRACT

A sprinkler structure includes a base with a rotatable stripe-shaped pipe and spraying pipes installed on the stripe-shaped pipe. The stripe-shaped pipe has an end connected to the base through a hollow shaft which has an outlet pipe, and the other end connected to the base through a pipe plug. A water fetching device is installed at an end of the base for driving the stripe-shaped pipe to rotate and includes a sleeve sheathed on the hollow shaft. A water fetching target is installed at an upper end of the sleeve and near the outlet of an outlet pipe. The base has an inlet pipe interconnected with the hollow shaft, the outlet pipe and the spraying pipe, and further has a conversion device for controlling the water fetching device to rotate in a forward or reverse direction.

2 Claims, 5 Drawing Sheets

SPRINKLER STRUCTURE

FIELD OF THE INVENTION

The present invention relates to a sprinkler structure, in particular to a sprinkler that can be rotated reciprocally to define the range of sprinkling water.

BACKGROUND OF THE INVENTION

Water dance equipments are sprinklers installed in a garden, a square or a lawn and provided for spraying water to a large area of plants. Since the conventional water dance equipments available in the market still have drawbacks such as having many internal components, incurring a high cost, and requiring a complicated structure, therefore the assembling of these equipments is very inconvenient. For example, the conventional sprinklers generally use gears that rotate in two different directions to drive a water spraying pipe to move reciprocally. However, such conventional sprinklers come with many components and require a high installation precision of gears, a highly difficult installation of the equipments, and a time-consuming process. Obviously, the conventional sprinklers require improvements.

SUMMARY OF THE INVENTION

In view of the deficiency of the prior art, it is a primary objective of the present invention to provide an improved sprinkler structure with the features of simple structure, reduced components, resources saving, improved assembling process and convenient assembling.

To achieve the aforementioned objective, the present invention provides an improved sprinkler structure, comprising: a base, a stripe-shaped pipe rotatable on the base, and a plurality of spraying pipes installed on the stripe-shaped pipe, wherein an end of the stripe-shaped pipe connects to a hollow shaft and is coupled to the base, and the hollow shaft has an outlet pipe installed thereon, and the other end of the stripe-shaped pipe couples to the base with a pipe plug, and a water fetching device is installed at an end of the base and capable of driving the stripe-shaped pipe to rotate, and the water fetching device comprises a sleeve sheathed on the hollow shaft, and a water fetching target is installed at an upper end of the sleeve and proximate to an outlet of the outlet pipe, and the base further has an inlet pipe installed thereon and interconnected with the hollow shaft, the outlet pipe and the spraying pipe, and the base further has a conversion device installed thereon for controlling the water fetching device to rotate in a forward and reverse direction.

Wherein, the conversion device includes a bracket, a bracket holder disposed at the bottom of the bracket, a conversion rod installed on the bracket holder, a bracket tube disposed at the top of the bracket holder and sheathed on the hollow shaft, a bracket outlet pipe installed onto the bracket tube for sheathing the outlet pipe, a first spring installed onto the bracket and connected to the sleeve and sheathed on the sleeve, a block portion disposed at the bottom of the sleeve, a switching buckle disposed on a side of the bracket holder and configured corresponsive to the block portion, a fixed disc mounted onto the base, and a position limiting slot formed on the fixed disc for inserting the conversion rod therein.

Further, the bracket holder includes a fixing hole, a pillar formed at an end of the conversion rod and plugged into the fixing hole, and a second spring bracket is connected between the holder and the conversion rod.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
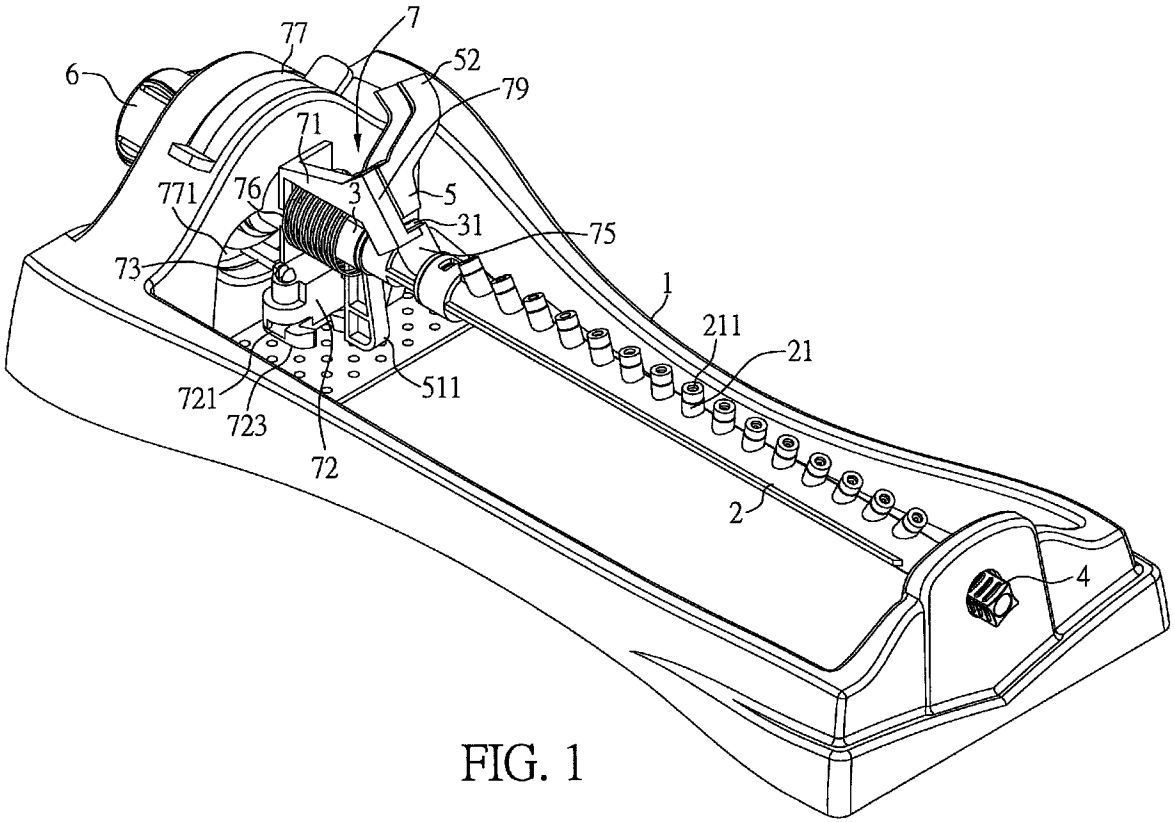
FIG. 1 is a perspective view of the present invention.
Figure 2:
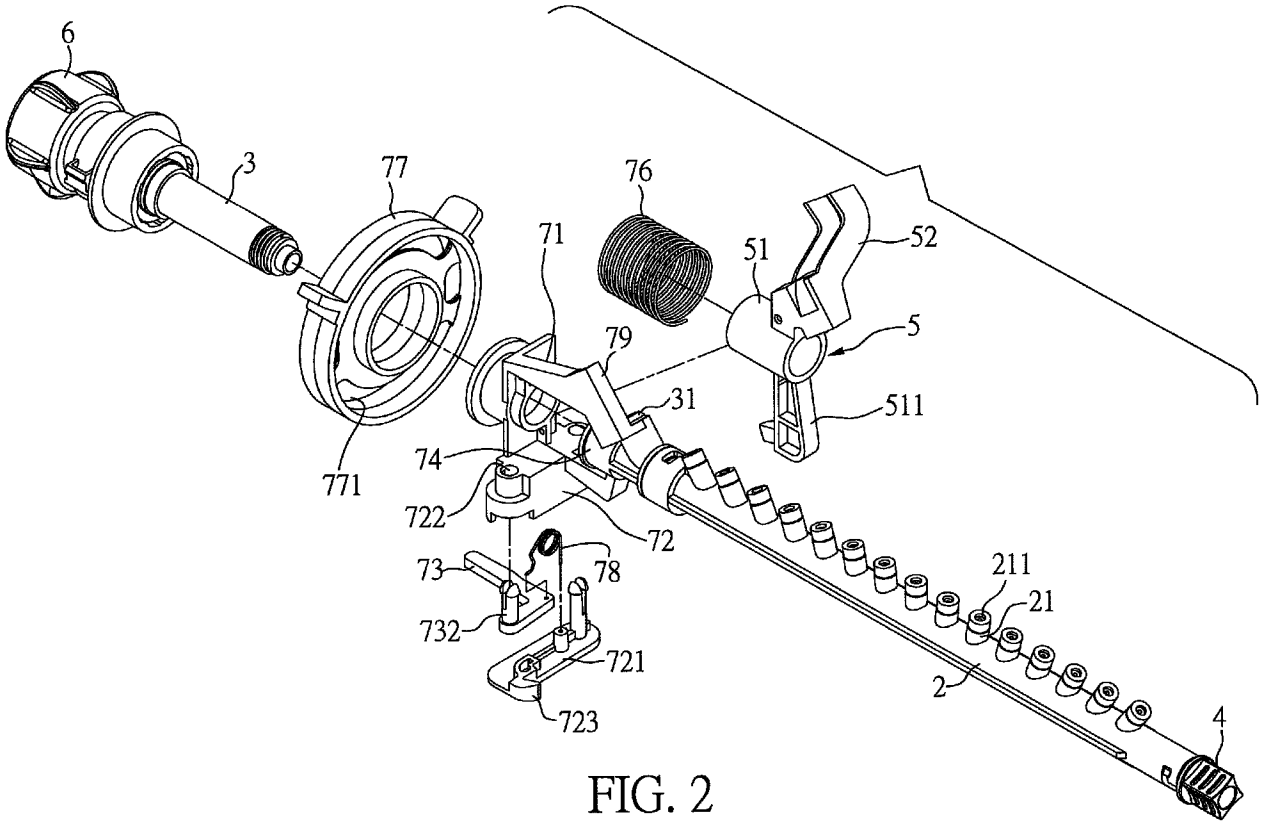
FIG. 2 is an exploded view showing a portion of components of the present invention.
Figure 3:
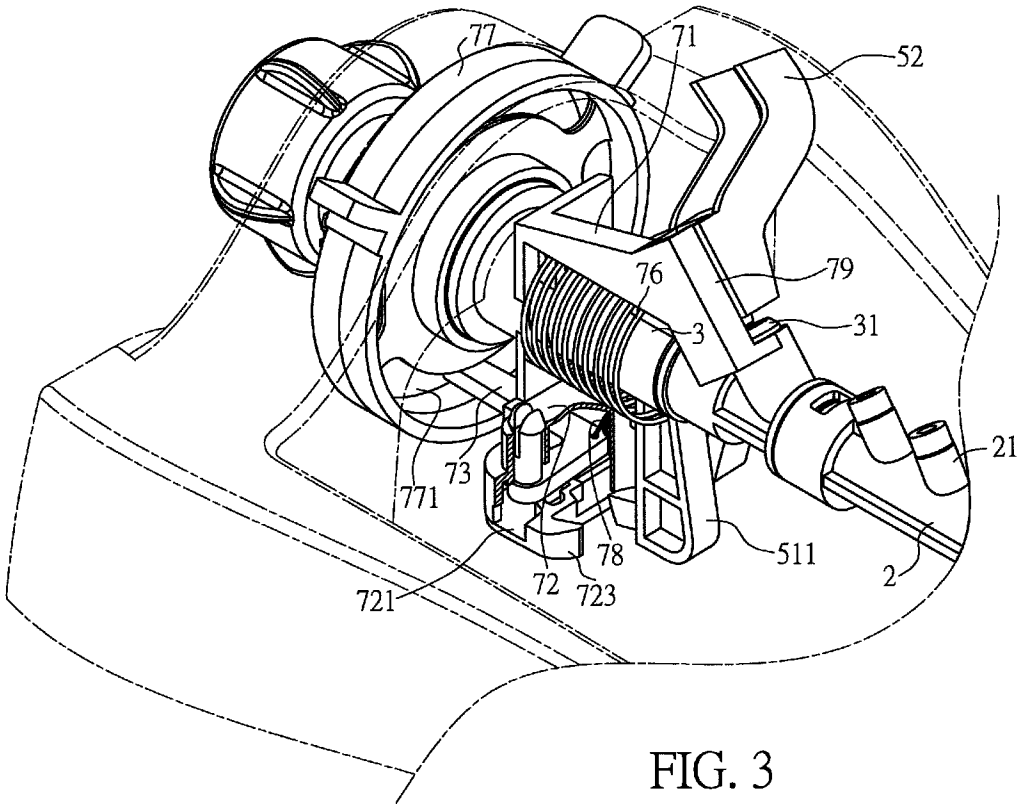
FIG. 3 is a partial blowup view of the present invention.

With reference to FIGS. 1 to 3 for an improved sprinkler structure of the present invention, the sprinkler structure comprises: a base 1; a stripe-shaped pipe 2 rotatable on the base 1; a plurality of spraying pipes 21 installed on the stripe-shaped pipe 2, each having a jet element 211 formed in the spraying pipe 21, and an end of the stripe-shaped pipe 2 connected to the hollow shaft 3 and being coupled to the base 1; an outlet pipe 31 installed on the hollow shaft 3, and the other end of the stripe-shaped pipe 2 coupled to the base 1 with a pipe plug 4; a water fetching device 5 installed at an end of the base 1 for driving the stripe-shaped pipe 2 to rotate, and the water fetching device 5 comprising a sleeve 51 sheathed on the hollow shaft 3, and a water fetching target 52 installed at an upper end of the sleeve 51 and proximate to an outlet of the outlet pipe 31, and the base 1 further has an inlet pipe 6 installed thereon and interconnected with the hollow shaft 3, the outlet pipe 31 and the spraying pipe 21.

The base 1 further includes a conversion device 7 for controlling the water fetching device 5 to rotate in a forward or reverse direction, and the conversion device 7 comprises a bracket 71, a bracket holder 72 disposed at the bottom of the bracket 71, a conversion rod 73 installed on the bracket holder 72, a bracket tube 74 installed at the top of the bracket holder 72 and sheathed and connected to the hollow shaft 3, a bracket outlet pipe 75 installed on the bracket tube 74 for sheathing the outlet pipe 31, and a first spring 76 installed on the bracket 71 and coupled to the sleeve 51 and sheathed on the sleeve 51. The sleeve 51 further has a block portion 511 extended from the bottom of the sleeve 51, and a switching buckle 721 is installed on a side of the bracket holder 72 and configured corresponsive to the block portion 511. The base 1 further includes a fixed disc 77 mounted thereon, and the fixed disc 77 has a position limiting slot 771 formed thereon for inserting the conversion rod 73 into the position limiting slot 771.

The bracket holder 72 has a fixing hole 722, and an end of the conversion rod 73 has a pillar 732 inserted into the fixing hole 722, and a second spring 78 is coupled between the bracket holder 72 and the conversion rod 73.

With the aforementioned structure, water is sprayed out from the outlet pipe 31 to impact and push the water fetching target 52 away, so as to drive the water fetching target 52 to pivot and pull the first spring 76 to produce an elastic resilient force, and such elastic force pulls the bracket 71 and the stripe-shaped pipe 2 to rotate in a direction (which is defined as a forward direction), and the elastic force also provides the force for resuming the water fetching target 52 to its original position, so that the stripe-shaped pipe 2 rotates in the forward direction continuously to produce a continuous rotation.

Figure 4:
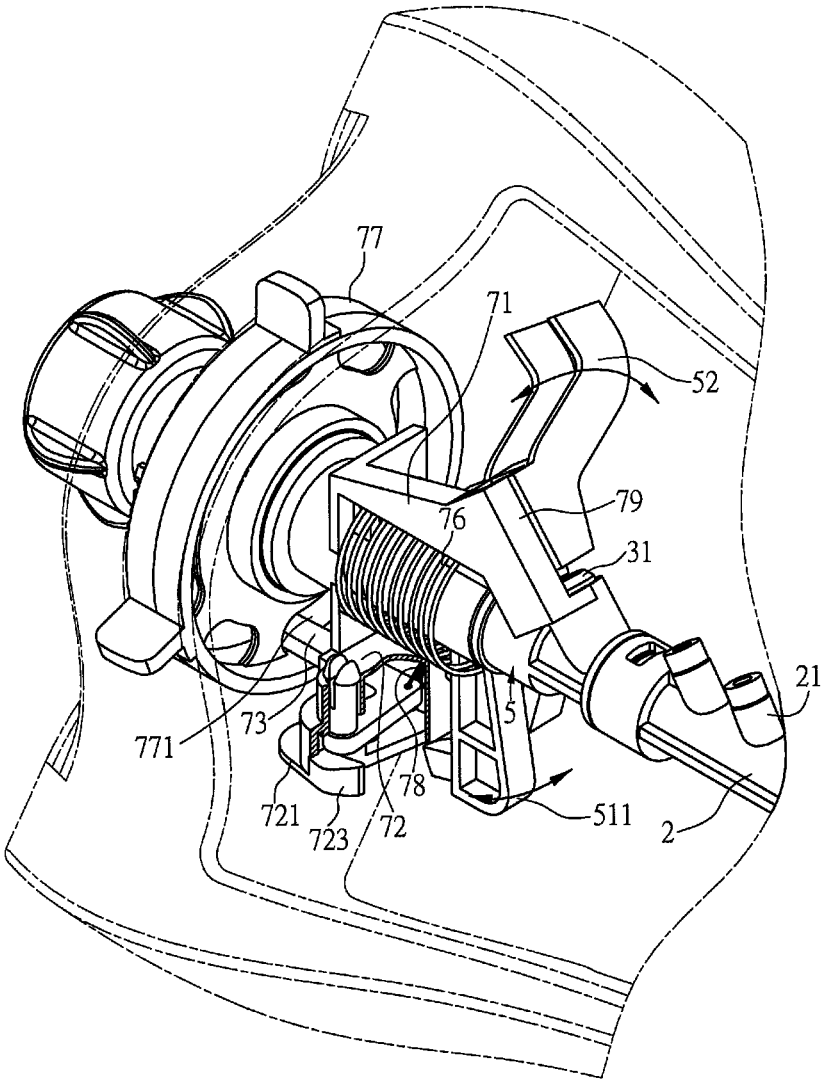
FIGS. 4 and 5 are schematic views showing an operating status of the present invention.
Figure 5:
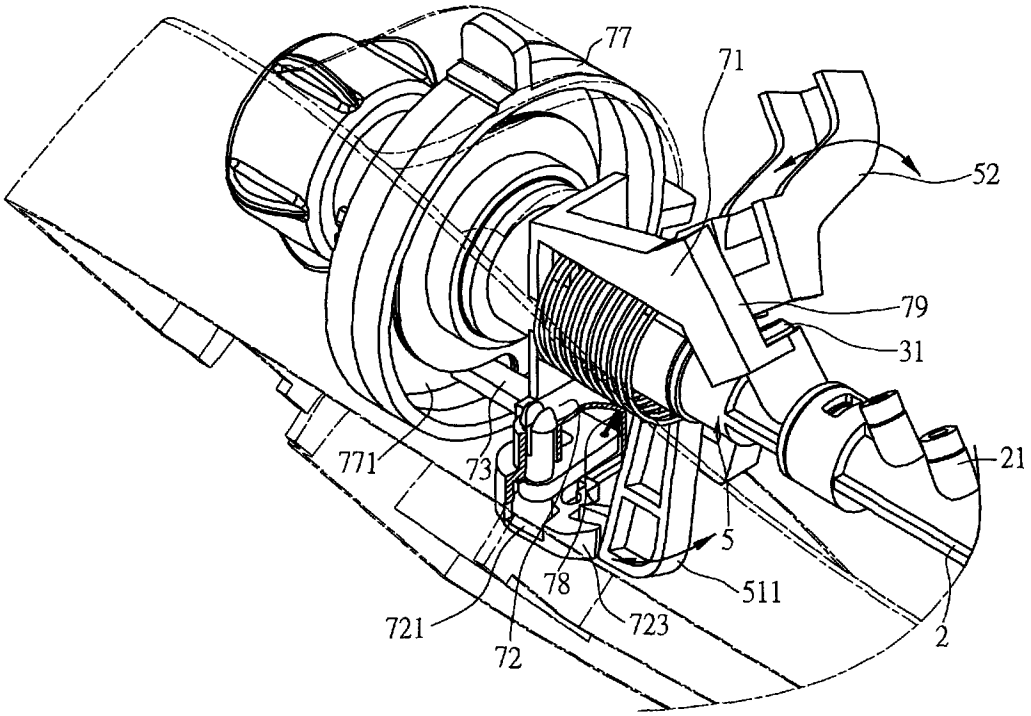

The present invention uses the conversion device 7 to switch the rotating direction of the stripe-shaped pipe 2, so that when the stripe-shaped pipe 2 is rotated to an end point of the pivoting range, the rotation is switched to an opposite direction. Specifically, the displacement of the conversion rod 73 is controlled to drive the second spring 78 to control the change of position of the switching buckle 721. Wherein, the conversion rod 73 is extended into the position limiting slot 771 of the fixed disc 77. Since the rotation of the water fetching target 52 drives the bracket 71, therefore the conversion rod 73 moves with the bracket 71 and slides in the position limiting slot 771. When the conversion rod 73 slides to one of the ends of the position limiting slot 771 as shown in FIG. 4, the conversion rod 73 is blocked by a wall and cannot continue to move further, so that the conversion rod 73 produces a pivoting movement to pull the second spring 78, and its elastic force pulls the switching buckle 721 to produce a displacement, wherein the switching buckle 721 has a stopper portion 723, so that when the switching buckle 721 is displaced, the stopper portion 723 still moves below the bracket holder 72. In other words, the stopper portion 723 has not been extended out from the bracket holder 72 yet. When the conversion rod 73 slides to the other end of the position limiting slot 771 as shown in FIG. 5, the conversion rod 73 is also blocked by the hole wall to produce a pivoting movement to pull the second spring 78, and its elastic force pulls the switching buckle 721 to extend the stopper portion 723 out from the bracket holder 72.

With the change of position of the stopper portion 723 of the switching buckle 721, the rotating direction of the stripe-shaped pipe 2 of the present invention can be controlled. The block portion 511 defines a pivoting range as the water fetching target 52 is pivoted. In the status of the stopper portion 723 being extended out from the bracket holder 72 as shown in FIG. 5, the stopper portion 723 is extended within the pivoting range of the block portion 511, so as to block the pivoting movement of the block portion 511 and reduce the pivoting stroke of the water fetching target 52. The bracket 71 has a interrupting portion 79 extended within the pivoting range of the water fetching target 52. Since the stopper portion 723 blocks the block portion 511 to reduce the pivoting stroke of the water fetching target 52, therefore the interrupting portion 79 is not affected when the water fetching target 52 is pivoted, and the bracket 71 and the stripe-shaped pipe 2 are situated at the status of rotating in the forward direction.

When the stopper portion 723 is not extended out from the bracket holder 72 as shown in FIG. 4, the pivoting movement of the block portion 511 is not blocked, so that the pivoting stroke of the water fetching target 52 is relatively larger, and the water fetching target 52 will hit the interrupting portion 79 continuously during the pivoting process, so as to push the bracket 71 to rotate in a reverse direction (which is opposite to the forward direction). Therefore, the stripe-shaped pipe 2 is driven to rotate in the reverse direction. By repeating the aforementioned two movements, the present invention can achieve the effect of rotating in forward and reverse directions repeatedly for the use of the sprinkler.

The advantage of the present invention resides on that a simple structure with less components is used to substitute the conventional gear structure to achieve the same reciprocal rotation effect. In addition, the invention may lower the assembling precision to save the assembling time and the manufacturing cost significantly while improving the assembly yield rate.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. A sprinkler structure, comprising a base, a stripe-shaped pipe rotatable on the base, and a plurality of spraying pipes installed on the stripe-shaped pipe, and an end of the stripe-shaped pipe connected to a hollow shaft and being coupled to the base, and the hollow shaft having an outlet pipe installed thereon, and the other end of the stripe-shaped pipe coupled to the base with a pipe plug, and a water fetching device being installed at an end of the base and capable of driving the stripe-shaped pipe to rotate, and the water fetching device comprising a sleeve sheathed on the hollow shaft, and a water fetching target being installed at an upper end of the sleeve and proximate to an outlet of the outlet pipe, and the base further having an inlet pipe installed thereon, and the inlet pipe being interconnected with the hollow shaft, the outlet pipe and the plurality of spraying pipes, and the base further having a conversion device installed thereon for controlling the water fetching device to rotate in a forward and reverse direction;

wherein the conversion device includes a bracket, a bracket holder disposed at the bottom of the bracket, a conversion rod installed on the bracket holder, a bracket tube disposed at the top of the bracket holder and sheathed on the hollow shaft, a bracket outlet pipe installed onto the bracket tube for sheathing the outlet pipe, a first spring installed onto the bracket and connected to the sleeve and sheathed on the sleeve, a block portion disposed at the bottom of the sleeve, a switching buckle disposed on a side of the bracket holder and configured corresponsive to the block portion, a fixed disc mounted onto the base, and a position limiting slot formed on the fixed disc for inserting the conversion rod therein.

2. The sprinkler structure of claim 1, wherein the bracket holder includes a fixing hole, a pillar formed at an end of the conversion rod and plugged into the fixing hole, and a second spring is connected between the bracket holder and the conversion rod.

* * * * *